US012350566B1

(12) United States Patent
Weathers

(10) Patent No.: US 12,350,566 B1
(45) Date of Patent: Jul. 8, 2025

(54) BASKETBALL TRAINING APPARATUS

(71) Applicant: Nolan Weathers, New York, NY (US)

(72) Inventor: Nolan Weathers, New York, NY (US)

( * ) Notice: Subject to any disclaimer, the term of this patent is extended or adjusted under 35 U.S.C. 154(b) by 0 days.

(21) Appl. No.: 19/019,933

(22) Filed: Jan. 14, 2025

(51) Int. Cl.
*A63B 69/00* (2006.01)

(52) U.S. Cl.
CPC ..... *A63B 69/0071* (2013.01)

(58) Field of Classification Search
CPC ..... A63B 69/0071; A63B 2243/0037
See application file for complete search history.

(56) References Cited

U.S. PATENT DOCUMENTS 1,583,041 A * 5/1926 Herrick ..... A01D 46/247 2/160
1,640,004 A * 8/1927 Lundblad ..... A41D 19/01547 2/160
3,033,567 A * 5/1962 Raab ..... A63D 5/00 124/5
5,085,320 A * 2/1992 Scott ..... A63B 47/007 206/315.9
5,242,348 A * 9/1993 Bates ..... A63B 21/072 482/93
5,570,882 A * 11/1996 Horkan ..... A41D 19/01552 473/573
5,730,287 A * 3/1998 Martin ..... A63B 47/00 206/315.9
5,839,577 A * 11/1998 Friedler ..... A63B 47/00 190/110
6,688,998 B2 * 2/2004 Hergert ..... A63B 41/08 473/603
6,892,916 B1 * 5/2005 Rugg ..... A63B 47/00 224/605
D577,390 S * 9/2008 Collier ..... D21/713
7,485,058 B1 * 2/2009 Payne ..... A63B 41/08 473/573
8,672,546 B2 * 3/2014 Jariwala ..... B65D 27/08 383/4
9,242,149 B2 * 1/2016 Carter ..... A63B 37/12
9,616,272 B1 * 4/2017 Bennett ..... A63B 21/00065
10,322,311 B2 * 6/2019 Naomi ..... A63B 21/002
2012/0028738 A1 * 2/2012 Love ..... A63B 71/141 473/438
2013/0017912 A1 * 1/2013 DeAngelis-Duffy ..... A63B 39/06 473/607
2013/0299370 A1 * 11/2013 Baker ..... A63B 47/00 206/315.9
2016/0279460 A1 * 9/2016 Leo ..... A63B 47/00
2018/0236337 A1 * 8/2018 Frith, Jr. ..... A63B 21/0552
2019/0076723 A1 * 3/2019 Cromartie ..... A63B 1/00

* cited by examiner

*Primary Examiner* — Melba Bumgarner
*Assistant Examiner* — Amir A Klayman
(74) *Attorney, Agent, or Firm* — Stanzione & Associates, PLLC; Patrick Stanzione

(57) ABSTRACT

A basketball training apparatus including a flexible basketball covering material with an opening configured to receive a basketball therethrough and a glove attached to the flexible basketball covering material to receive a ball handler's hand therein to perform basketball handling and dribbling moves, as well as experiencing "ball-in-hand" dribble time, without the need to release the basketball from being in contact with the ball handler's hand.

4 Claims, 3 Drawing Sheets

BASKETBALL TRAINING APPARATUS

STATEMENT REGARDING FEDERALLY SPONSORED RESEARCH OR DEVELOPMENT

Not applicable.

COPYRIGHT NOTICE

A portion of this disclosure contains material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever. 37 C.F.R 1.71(d).

BACKGROUND OF THE INVENTIVE CONCEPT

1. Field of the Invention

The present inventive concept is related to a basketball training apparatus, and more particularly to a basketball training apparatus that enables a user to practice different types of basketball handling and dribbling moves with a basketball in the user's hand without the need to dribble the basketball against any surface.

2. Description of the Related Art

Basketball dribbling and handling skills are necessary in order to play the game of basketball. These skills are learned with practice and can be continuously improved over the lifetime of a basketball player by practicing these dribbling and handling skills and by playing the game of basketball. Such dribbling and handling skills generally require a user (aka: a ball-handler) to bounce a basketball continuously while performing such dribbling and handling skills since the game of basketball includes rules that require a ball-handler to continuously dribble a basketball while moving around a basketball court with the basketball. However, a basketball court is not always available for a ball-handler to access when desiring to practice their basketball dribbling and handling skills. Some devices have been developed to assist a ball-handler to perform different moves with a basketball. A few of these apparatuses are listed below.

US 2004/0005939 A1 by Bourguet describes a device for training a person to dribble a basketball with a basketball support, including a strap coupled to the basketball support. This device permits the user to be able to dribble a basketball such that mishandled dribbles or a collision between the ball and an obstacle will not lead to a loose ball that has to be chased down. However, this device requires a user to actually dribble a basketball on a ground or other flat surface, which can be very impractical when the user is limited to practicing basketball dribbling and handling moves indoors, such as in an apartment, home or other indoors location where dribbling a basketball is inconvenient or disruptive.

US 2007/0099731 A1 by Weber et al. discloses a sports ball catch training apparatus 200 that places an object ball 210 in the hand of a user with the aid of an elastic strap 220, and a comfort patch 230. This apparatus 200 is designed to help a user to develop "fingertip control," requiring a ball to be caught, set, shot, or dribbled by using only their fingertips. Here the ball is required to be caught, set, shot or dribbled with the fingertips and thumb tips, and "should not come in contact with the palm of the hands" (see paragraph [0005]). Hence, the object ball 210 must be lightweight, and therefore cannot practically include a basketball. Further, a basketball requires a user to make contact with the ball by using their palm as well as their fingertips. Accordingly, this sports ball catch training apparatus is not practical for use with a basketball.

US 2007/0270248 A1 by Ffrench discloses a basketball training aid designed to teach and keep the user's hand in the proper position to correctly shoot and release a basketball. This training aid is designed to receive a user's fingers and is to be worn at the base of the fingers. This device encourages proper finger separation, spacing of a ball off the palm. However, this device is specifically designed for a user to properly position a ball in the hand for proper release of the ball when shooting the basketball at a basket and does not enable a user to dribble a basketball in any way, let alone to dribble a basketball without the need to bounce a basketball on a surface.

US 2009/0318248 A1 by Russotti discloses a basketball training aid designed to teach a user how to correctly grip, set up, and release a basketball. This training aid includes a glove with a splint support material on top of the index, middle, and ring fingers. This splint support material prevents premature finger flexion at the base of the fingers during the release of a shot, ensuring an open hand at follow through. This design encourages proper finger separation and proper extension of wrist and joint on set up, keeps the ball off the palm of the hand, and promotes proper position for dribbling a basketball effectively. However, this training aid requires a user to dribble a basketball on a surface, such as a floor or ground, which is impractical and disruptive when the user is indoors, such as in an apartment or other residential structure.

Accordingly, there is a need for a basketball training apparatus that enables a ball handler to handle a basketball to perform a plurality of dribbling and ball handling operations without the need to actually bounce the basketball on a surface.

There is also a need for a basketball training apparatus that enables a ball handler to handle a basketball to perform a plurality of dribbling and ball handling operations without the need to release a basketball from their hand.

There is also a need for a basketball training apparatus that enables a junior ball handler to be able to palm a basketball and feel the weight of a basketball in their hand while practicing "ball-in-hand" time.

There is also a need for a basketball training apparatus that enables a ball handler to handle a basketball to practice basketball dribbling related skills, such as to manipulate their hand to control "ball-in-hand time," which is a more recently used concept/skill in the sport of basketball.

Other features and advantages of the present inventive concept will be evident and/or are described in more detail below.

SUMMARY OF THE INVENTIVE CONCEPT

The present general inventive concept relates to a basketball training apparatus. More particularly, but not exclusively, the present inventive concept relates to a basketball training apparatus that includes a flexible basketball covering material that can receive a basketball therein and a pocket attached to the flexible basketball covering material to receive a user's hand therein to enable a user to "palm" a basketball and perform different ball handling moves, dribbling skills and other exercises with a basketball while maintaining the basketball in contact with the user's hand.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a basketball training apparatus, including: a basketball covering material having an opening configured to receive a basketball therein and a flap to cover the opening once a basketball is inserted into the basketball covering material; and a pocket attached to the basketball covering material, the pocket configured to receive a ball handler's hand therein to keep the inserted basketball against the ball handler's palm and fingers while performing basketball handling and dribbling moves.

In an example embodiment, the basketball covering material can be formed of a flexible material that stretches to receive a basketball through the opening and securely retains the basketball against an inner surface thereof.

In another example embodiment, the pocket can be formed in the shape of a glove with five sections, each section configured to receive a finger of the ball handler.

In still another example embodiment, the pocket can be sewn to the inner surface of the basketball covering material extending inward from the flap.

In still another example embodiment, the pocket can be sewn to the outer surface of the basketball covering material.

In yet another example embodiment, the basketball training apparatus can further include a hook and loop feature connected to an inner surface of the flap and an outer surface of the basketball covering material to retain the flap over the opening.

The foregoing and/or other features and utilities of the present general inventive concept may also be achieved by providing a basketball handling assistance apparatus, including: a flexible round-shaped material having an opening with two opposing sides configured to stretch away from each other to receive a basketball therethrough and into the flexible round-shaped material, one of the two opposing sides being configured to stretch over the other one of the two opposing sides to cover the opening; and a glove attached to the flexible round-shaped material, the glove configured to receive a ball handler's hand therein to keep the inserted basketball against the ball handler's hand while performing basketball handling and dribbling moves.

In an example embodiment, the glove can be attached to an outer surface of the flexible round-shaped material.

In another example embodiment, the basketball handling assistance apparatus can further include a hook and loop feature that attaches two opposing sides to each other to securely retain a basketball within the flexible round-shaped material.

In still another example embodiment, the glove can be attached to an inner surface of the flexible round-shaped material such that a user's hand can be inserted into the glove through the opening.

Additional features and utilities of the present general inventive concept will be set forth in part in the description which follows and, in part, will be obvious from the description, or may be learned by practice of the general inventive concept.

BRIEF DESCRIPTION OF THE DRAWINGS

These and/or other features and utilities of the present inventive concept will become apparent and more readily appreciated from the following description of the embodiments, taken in conjunction with the accompanying drawings of which.

Figure 1A:
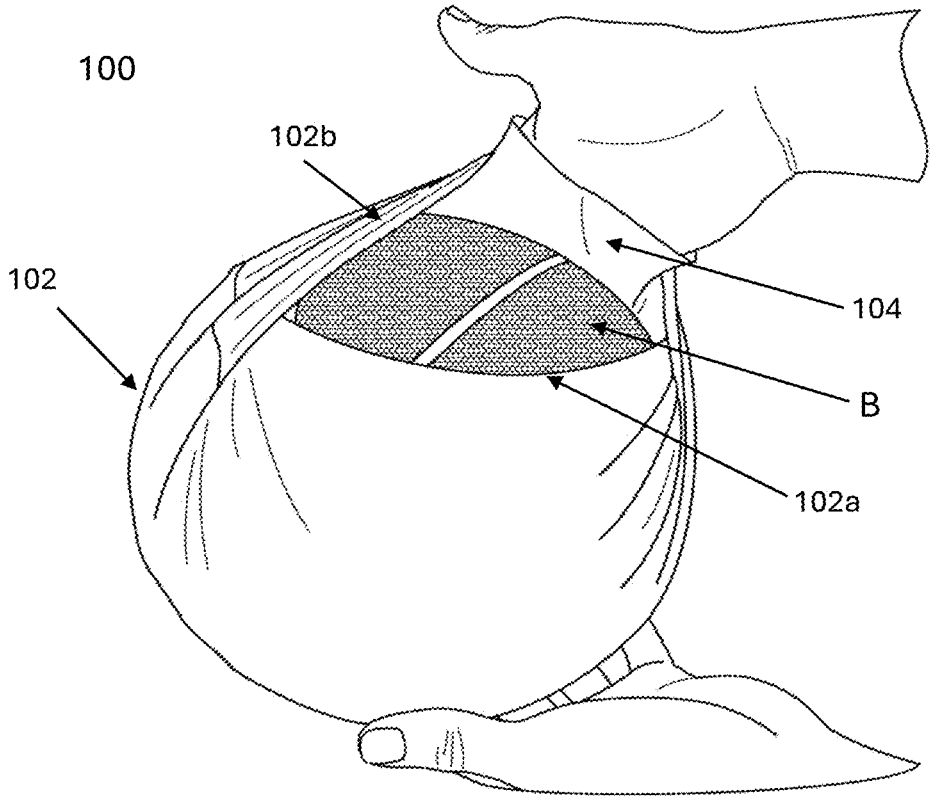
FIG. 1A illustrates a first perspective view of a basketball training apparatus according to an example embodiment of the present inventive concept.

The drawings illustrate a few example embodiments of the present inventive concept and are not to be considered limiting in its scope, as the overall inventive concept may admit to other equally effective embodiments.

DETAILED DESCRIPTION OF THE PREFERRED EMBODIMENTS

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures. Also, while describing the present general inventive concept, detailed descriptions about related well-known functions or configurations that may diminish the clarity of the points of the present general inventive concept are omitted for brevity purposes.

It will be understood that although the terms "first" and "second" are used herein to describe various elements, these elements should not be limited by these terms. These terms are only used to distinguish one element from another element. Thus, a first element could be termed a second element, and similarly, a second element may be termed a first element without departing from the teachings of this disclosure.

Expressions such as "at least one of," when preceding a list of elements, modify the entire list of elements and do not modify the individual elements of the list.

All terms including descriptive or technical terms which are used herein should be construed as having meanings that are obvious to one of ordinary skill in the art. However, the terms may have different meanings according to the intention of the lexicographer, case precedents, or the appearance of new technologies. Also, some terms may be arbitrarily selected by the inventors, and in this case, the meaning of the selected terms will be described in detail in the detailed description herein. Thus, the terms used herein should be defined based on the generally defined meaning of the terms together with the description throughout this specification.

Hereinafter, one or more exemplary embodiments of the present general inventive concept will be described in detail with reference to accompanying drawings.

Example embodiments of the present general inventive concept are directed to a basketball training apparatus. More particularly, but not exclusively, the present inventive concept relates to a basketball training apparatus that includes a flexible basketball covering that can receive a basketball therein and a pocket attached to the flexible basketball covering to receive a user's hand therein to enable a user to perform different ball handling moves and exercises with a basketball while maintaining the basketball in contact with the user's hand.

FIG. 1A illustrates a first perspective view of a basketball training apparatus 100 according to an example embodiment of the present inventive concept. Referring to FIG. 1A, the basketball training apparatus 100 according to this example embodiment can include a basketball covering material 102 formed into a round shape to receive a basketball securely and tightly therein. The basketball covering material 102 is preferably formed of a flexible material and can include an opening 102*a* formed therein. The opening 102*a* is preferably configured to be stretchable to insert a basketball B therethrough and into the basketball covering material 102. More specifically, the flexible basketball shaped material 102 can include a first side that terminates to form the opening 102*a* and a second side that forms a flap 102*b* that folds over the opening 102*a* to cover the opening 102*a*. The flap 102*b* is configured to be able to be pulled back away from the opening 102*a* to enable a user to insert a basketball B through the opening 102*a* such that the flexible fabric material 102 will surround and firmly cover the basketball B, except for the opening portion 102*a*. The flap 102*b* can then be stretched over the opening 102*a* to cover the opening 102*a*. The flexible fabric material 102 can be formed from a stretchable fabric, such as polyester, spandex, Lycra, etc. It is to be noted that the basketball covering material 102 can alternatively be formed of any type of stretchable material which will perform the intended purposes as described herein, without departing from the spirit and scope of the overall present inventive concept.

In an example embodiment, the outer surface of the basketball covering material 102 and the inner side of the flap 102*b* can each include a hook and loop strip, respectively, or a snap feature, to attach the flap 102*b* to the outer surface of the basketball covering material 102. This hook and loop feature is especially helpful in the case where the basketball covering material 102 is not formed of a flexible material, which would naturally firmly cover the opening 102*a* without any assistance from an attachment device, such as a hook and loop feature.

Once the basketball B is fully inserted through the opening 102*a* so that the flexible fabric material 102 covers the basketball B the flap 102*b* can be folded over the opening 102*a* to enclose and entirely cover the basketball B. The flab 102*b* is preferably stretchable so that the flap 102*b* automatically folds over the opening 102*a* to cover the same. After a basketball B is inserted through the opening 102*a* and the flap 102*b* covers the opening 102*a* so that a user can perform basketball B training exercises with a basketball B in hand, the user can insert one hand into a separate pocket 104 sewn within the flexible fabric material 102, as described in more detail below.

Figure 1B:
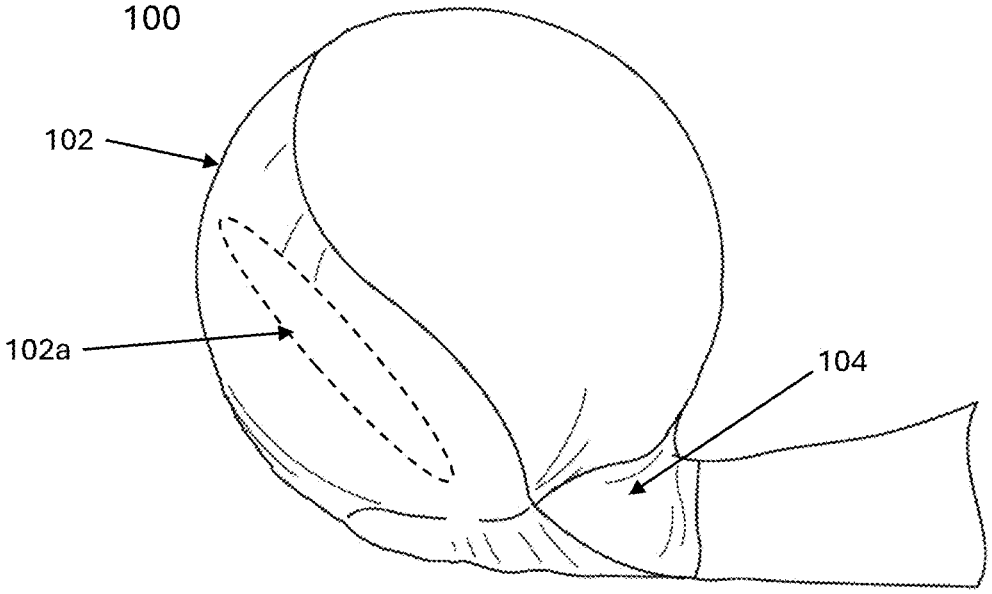
FIG. 1B illustrates another perspective view of the basketball training apparatus according to the example embodiment of FIG. 1A.

Still referring to FIG. 1A, the separate pocket 104 can be sewn to an inner wall of the flexible fabric material 102. More specifically, the separate pocket 104 can be sewn within the flexible fabric material 102 such that the pocket 104 begins at a position adjacent to the end of the flap 102*b* and extends into the basketball shaped flexible fabric material 102. In an example embodiment the separate pocket 104 can be formed into a shape of a glove including five individual sections, each section configured to receive a respective finger of a user such that an entire hand of a user can be securely inserted into the pocket 104. The glove shaped pocket 104 can be formed from the same flexible fabric material, such as polyester, spandex, Lycra, etc., or can be formed of any type(s) of material which will perform the intended purposes as described herein, without departing from the spirit and scope of the overall present inventive concept FIG. 1B illustrates another perspective view of the basketball training apparatus 100 according to the example embodiment of FIG. 1A. As illustrated in FIG. 1B, once a user's (aka: ball handler) hand is fully inserted into the glove shaped pocket 104 the user's hand will be positioned to "palm" the basketball B inserted in the basketball shaped flexible fabric material 102 while the user's hand and fingers are securely pressed against the basketball B. In this position the ball handler will be able to feel the actual weight of a basketball against their hand even if the ball handler's hand is not large enough to be able to palm a basketball B. Further, the ball handler will be able to manipulate their hand to control their "ball-in-hand time," which is a more recently practiced and used concept in the sport of basketball. Further, the ball handler will be able to perform an endless number of moves with a basketball B remaining against the palm of their hand. There are a plurality of basketball dribbling moves to practice in order to achieve advanced basketball handling skills. Many of these basketball dribbling moves can be practiced indoors with the basketball training apparatus 100, according to the example embodiment of FIG. 1A, without the basketball B being required to touch the ground or even being released from the ball-handler's hand. Some of the dribbling moves include, for example a "hesitation dribble," where a ball-handler briefly pauses or slows their dribble, using the hesitation to misdirect the defender, a "step-back dribble," a move in which the ball-handler takes a step back from the defender while dribbling the ball, creating space for a jump shot or drive to the basket, a "change of pace dribble," a move in which the ball-handler changes the speed of their dribble, using the sudden change to create space or misdirect the defender, a "side-step dribble," a move in which the ball-handler takes a lateral step away from the defender while dribbling the ball, creating space for a jump shot or drive to the basket, a "crossover step-back dribble," a combination of the crossover dribble and the step-back dribble, using quick changes of direction and body positioning to create space, a "euro-step dribble," a move in which the ball-handler takes a long step in one direction, then quickly changes direction and takes another step, using the momentum to create space for a layup or shot, a "half-spin dribble," a move in which the ball-handler dribbles the ball and simultaneously half-spins their body, using the spin to create space or change direction, a "hesitation crossover dribble," a combination of the hesitation dribble and the crossover dribble, using a pause and a quick change of direction to create space, etc. Each of these types of dribbling moves, as well as many others, can be practiced by using the basketball training apparatus 100 according to the example embodiment of FIG. 1A without the need to actually bounce a basketball B on any surface, such as a floor of an apartment, home, etc., where bouncing a basketball can be highly impractical and disturbing to others.

Figure 2:
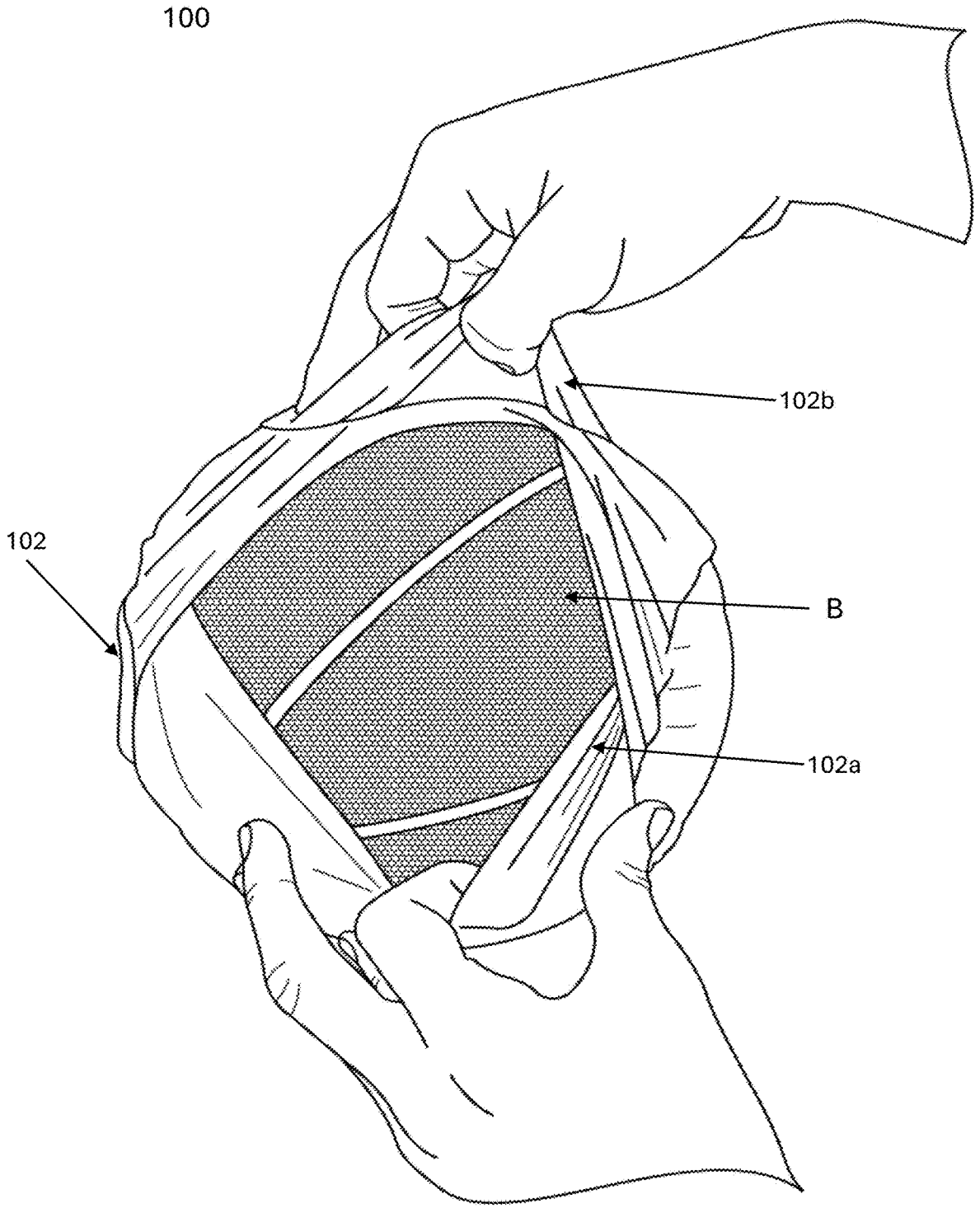
FIG. 2 illustrates still another perspective view of the basketball training apparatus according to the example embodiment of FIG. 1A.

FIG. 2 illustrates still another perspective view of the basketball training apparatus 100 according to the example embodiment of FIG. 1A. FIG. 2 illustrates how the flap 102*b* can be pulled back away from the opening 102*a* while the opening 102*a* is stretched to be able to insert a basketball B therethrough such that a basketball B can be fully inserted within the basketball shaped flexible fabric material 102. In this example figure the glove shaped pocket 104 is not illustrated in order to illustrate the cooperative operations of the opening 102*a* and flap 102*b* to be able to insert a basketball B within the basketball shaped flexible fabric material 102.

Figure 3A:
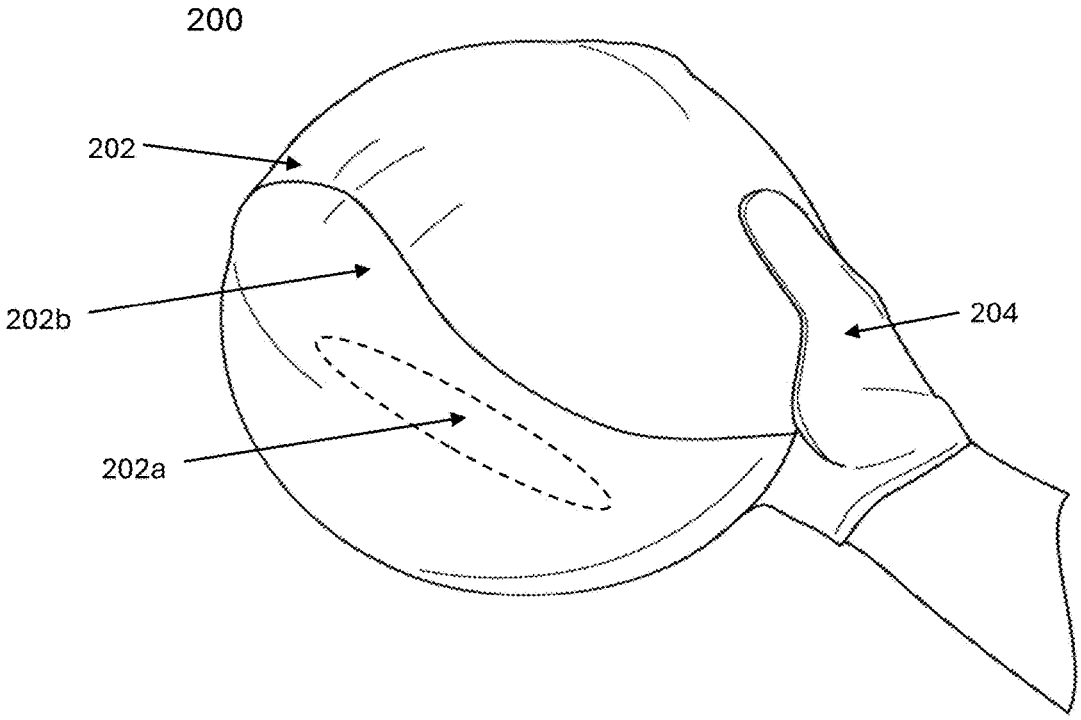
FIG. 3A illustrates a first perspective view of a basketball training apparatus according to another example embodiment of the present inventive concept.

FIG. 3A illustrates a first perspective view of a basketball training apparatus according to another example embodiment of the present inventive concept. Referring to FIG. 3, the basketball training apparatus 200 according to this example embodiment is similar to the basketball training apparatus 100 illustrate in FIG. 1A, except that a glove shaped pocket 204 is sewn to an outer surface of a basketball shaped flexible fabric material 202 instead of the inner surface thereof. The basketball shaped flexible fabric material 202 in this example embodiment can include an opening 202*a* formed therein similar to the opening 102*a* illustrated in the example embodiment of FIG. 1A. The basketball shaped flexible fabric material 202 can include a first end that terminates to form the opening 202*a* and a second end that forms a flap 202*b* that folds over the opening 202*a* to cover the opening 202*a*. The flap 102*b* is configured to be able to be pulled back away from the opening 102*a* to enable a user to insert a basketball B through the opening such that the basketball shaped flexible fabric material 102 will tightly cover most of the basketball B except for the opening portion 102*a*. The basketball shaped flexible fabric material 102 can be formed from a stretchable fabric, such as polyester, spandex, Lycra, etc. It is to be noted that the basketball shaped flexible fabric material 102 can be formed of any type of stretchable material which will perform the intended purposes as described herein, without departing from the spirit and scope of the overall present inventive concept.

Figure 3B:
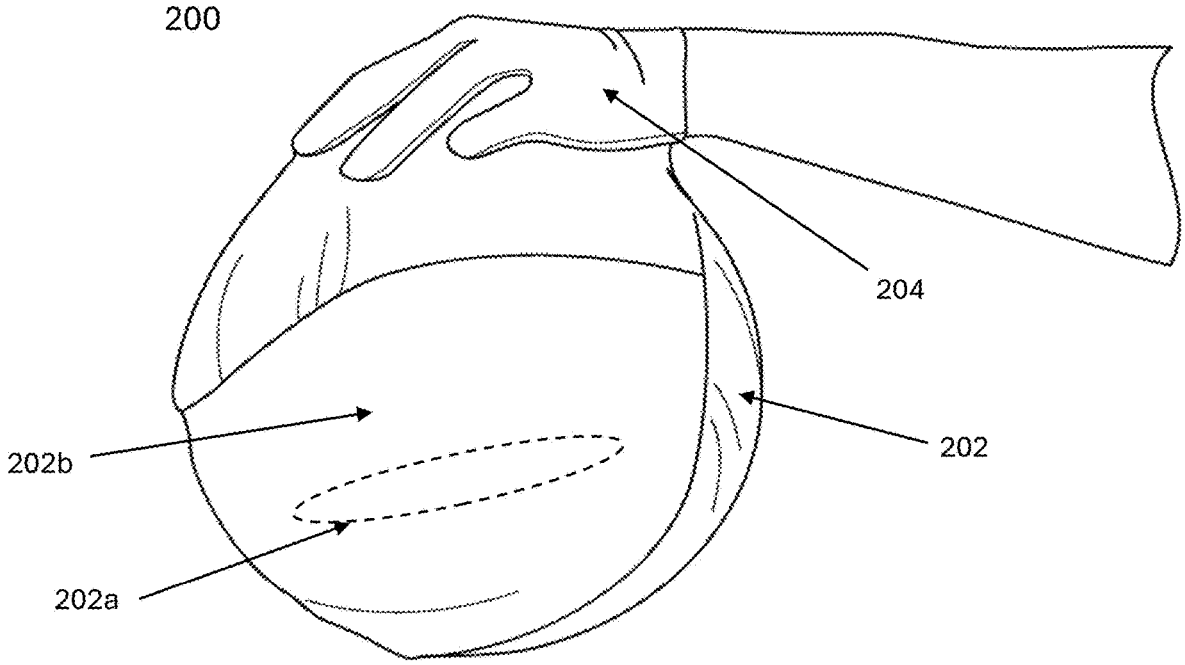
FIG. 3B illustrates another perspective view of the basketball training apparatus according to the example embodiment of FIG. 3A.

FIG. 3B illustrates another perspective view of the basketball training apparatus 200 according to the example embodiment of FIG. 3A. As illustrated in FIG. 3B, once a user's (aka: ball handler) hand is fully inserted into the glove shaped pocket 204 the user's hand will be positioned to "palm" the basketball B inserted in the basketball shaped flexible fabric material 202 while the user's hand and fingers are securely pressed against the basketball B. In this position the ball handler will be able to feel the actual weight of a basketball against their hand even if the ball handler's hand is not large enough to be able to palm a basketball B. Further, the ball handler will be able to manipulate their hand to control their "ball-in-hand time," as pointed out above with reference to FIGS. 1A-1B. Further, the ball handler will be able to perform an countless number of dribbling moves with a basketball B remaining against the palm of their hand. Each of these types of dribbling moves can be practiced by using the basketball training apparatus 200 according to the example embodiment of FIG. 3A without the need to actually bounce a basketball B on any surface, such as a floor of an apartment, home, etc., where bouncing a basketball can be highly impractical and disturbing to others Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

The invention claimed is:

1. A basketball training apparatus, comprising:

a basketball covering material formed of a flexible material that stretches to receive a basketball through the opening and securely retains the basketball against an inner surface thereof, including:

an opening configured to receive a basketball therein, and a flap to cover the opening once a basketball is inserted into the basketball covering material; and a pocket attached to and sewn to the inner surface of the basketball covering material and extending inward from the flap, the pocket configured to have the shape of a glove with five sections, each section formed to receive a finger of the ball handler keep the inserted basketball against the ball handler's palm and fingers while performing basketball handling and dribbling moves.

2. The basketball training apparatus according to claim 1, further comprising:

a hook and loop feature connected to an inner surface of the flap and an outer surface of the basketball covering material to retain the flap over the opening.

3. A basketball handling assistance apparatus, comprising:

a flexible round-shaped material including:

an opening with two opposing sides configured to stretch away from each other to receive a basketball therethrough and into the flexible round-shaped material, one of the two opposing sides being configured to stretch over the other one of the two opposing sides to cover the opening; and a glove attached to an inner surface of the flexible round-shaped material such that a ball handler's hand can be inserted into the glove through the opening to keep the inserted basketball against the ball handler's hand while performing basketball handling and dribbling moves.

4. The basketball handling assistance apparatus according to claim 3, further comprising a hook and loop feature that attaches two opposing sides to each other to securely retain a basketball within the flexible round-shaped material.

* * * * *